US009398358B2

(12) United States Patent
Louh

(10) Patent No.: US 9,398,358 B2
(45) Date of Patent: Jul. 19, 2016

(54) SPEAKER AND DISPLAY HAVING SAME

(71) Applicant: HON HAI PRECISION INDUSTRY CO., LTD., New Taipei (TW)

(72) Inventor: Sei-Ping Louh, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 67 days.

(21) Appl. No.: 14/055,889

(22) Filed: Oct. 17, 2013

(65) Prior Publication Data

US 2015/0086063 A1 Mar. 26, 2015

(30) Foreign Application Priority Data

Sep. 25, 2013 (TW) ..... 102134423 A

(51) Int. Cl.
*H04R 1/02* (2006.01)
*H04R 7/04* (2006.01)

(52) U.S. Cl.
CPC ..... *H04R 1/028* (2013.01); *H04R 1/025* (2013.01); *H04R 7/045* (2013.01); *H04R 2440/05* (2013.01); *H04R 2499/15* (2013.01)

(58) Field of Classification Search
USPC ..... 381/386, 395
See application file for complete search history.

(56) References Cited

U.S. PATENT DOCUMENTS

| | | | | |
|---|---|---|---|---|
| 5,025,474 | A * | 6/1991 | Tanaka et al. | 381/333 |
| 6,359,270 | B1 * | 3/2002 | Bridson | 219/679 |
| 7,743,877 | B2 * | 6/2010 | Saiki | H04R 1/2803 181/148 |
| 2009/0034759 | A1 * | 2/2009 | Ko et al. | 381/152 |
| 2014/0093114 | A1 * | 4/2014 | Nguyen | H04R 1/02 381/361 |

* cited by examiner

*Primary Examiner* — Davetta W Goins
*Assistant Examiner* — Amir Etesam
(74) *Attorney, Agent, or Firm* — Novak Druce Connolly Bove + Quigg LLP

(57) ABSTRACT

A speaker includes a hollow glass substrate and a plurality of vibration exciters. The glass substrate defines a hermetical receiving cavity. The vibration exciters are received in the receiving cavity, and are attached to the glass substrate to drive the glass substrate to vibrate, thus generating sound waves. The disclosure further relates a display having the speaker.

2 Claims, 6 Drawing Sheets

SPEAKER AND DISPLAY HAVING SAME

BACKGROUND

1. Technical Field

The present disclosure relates to a speaker and a display.

2. Description of Related Art

Many displays do not have a speaker, therefore, users must connect an external speaker to the display, which is very inconvenient.

Therefore, it is desirable to provide a speaker and a display that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
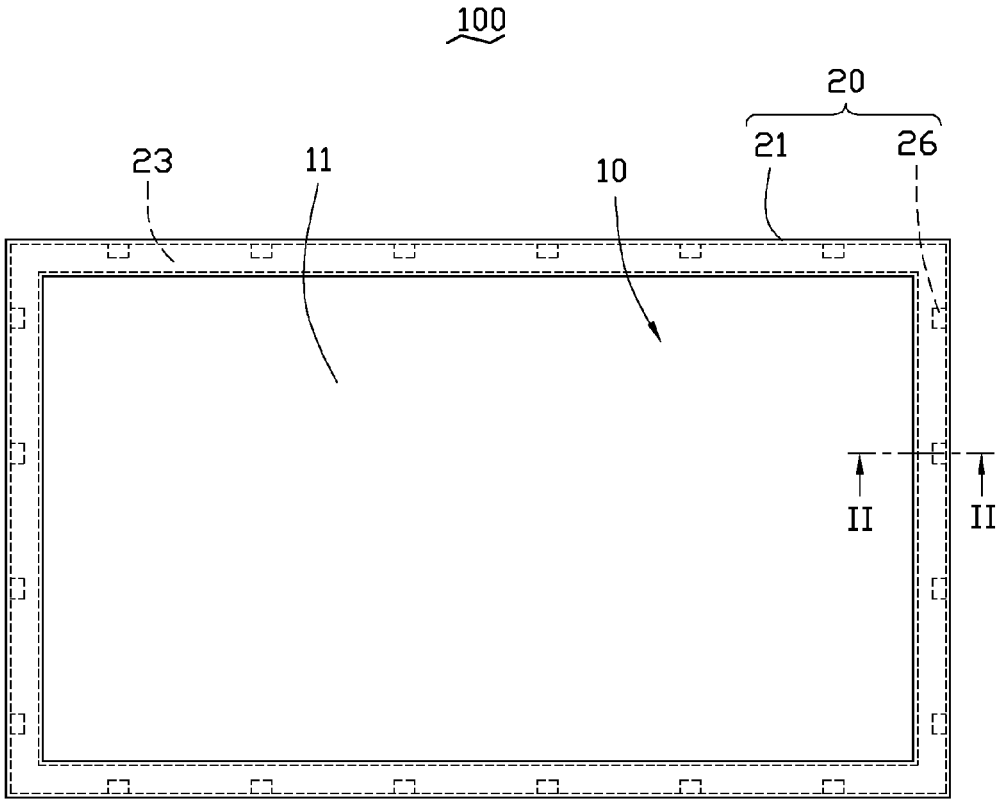
FIG. 1 is a schematic view of a display, according to a first exemplary embodiment.
Figure 2:
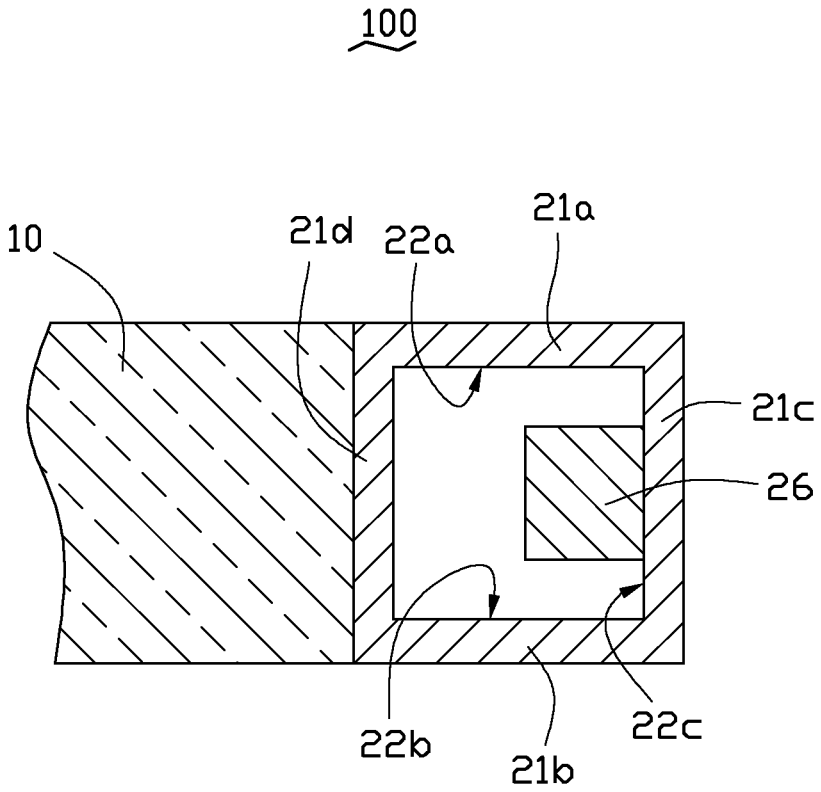
FIG. 2 is a partial cross-sectional view of the display taken along a line II-II of FIG. 1.
Figure 3:
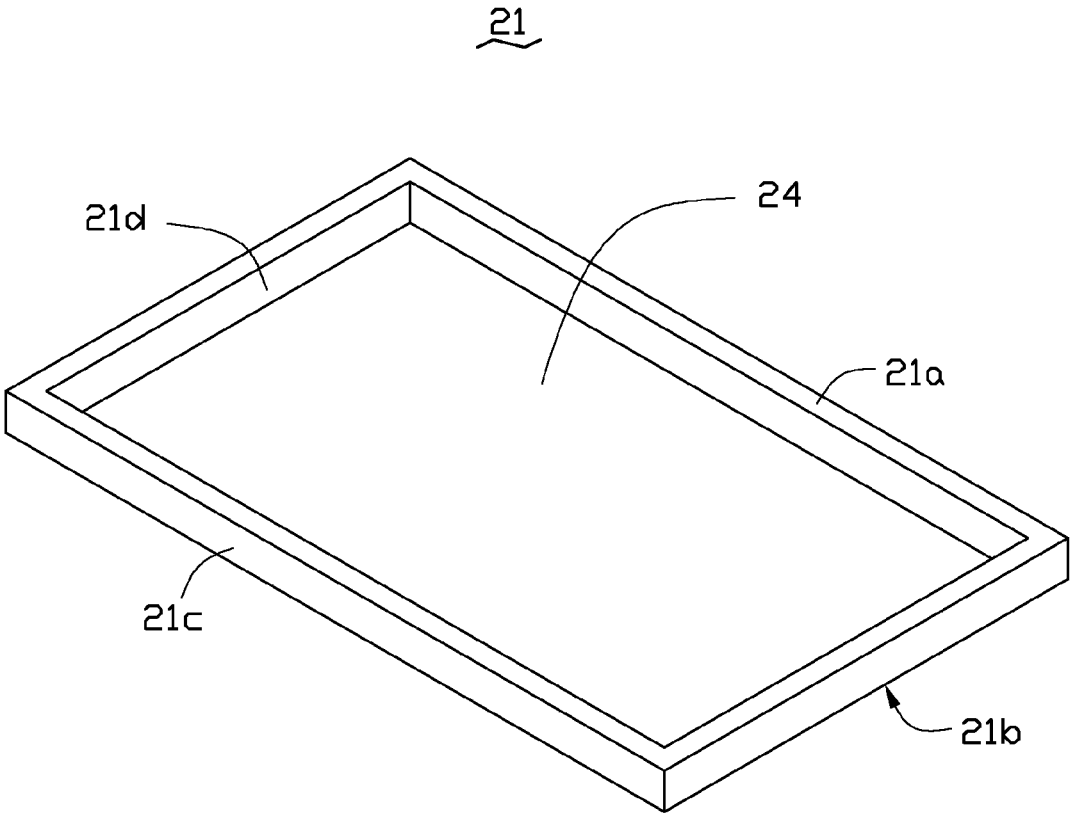
FIG. 3 is a schematic view of a glass housing of the display of FIG. 1.

FIGS. 1-3 illustrate a display 100 of a first exemplary embodiment. The display 100 includes a display panel 10 and a speaker 20.

The display panel 10 is used for displaying images according to received image signals. The display panel 10 includes a display surface 11. In the first embodiment, the display panel 10 is a liquid crystal display, and includes a horizontal polarizer, a color filter, a liquid crystal layer, a thin film transistor, a vertical polarizer, a driving circuit board, a diffusion sheet, and a backlight module.

The speaker 20 includes a hollow glass housing 21 and a number of vibration exciters 26. The glass housing 21 is fixed on the display panel 10. The glass housing 21 defines a hermetical receiving cavity 23. The glass housing 21 is substantially rectangular frame-shaped, and includes a front wall 21*a*, a back wall 21*b*, an outer wall 21*c*, and an inner wall 21*d*. The front wall 21*a* is adjacent to the display surface 11. The back wall 21*b* is opposite to the front wall 21*a*. The outer wall 21*c* is opposite to the inner wall 21*d*. Both of the outer wall 21*c* and the inner wall 21*d* are connected to the front wall 21*a* and the back wall 21*b*.

The glass housing 21 has a through hole 24 passing through the front wall 21*a* and the back wall 21*b*. The through hole 24 fits with the display panel 10, and thus the glass housing 21 surrounds the display panel 10. The outer wall 21*d* is away from the display panel 10. The inner wall 21*d* is in contact with the display panel 10.

The vibration exciters 26 are received in the receiving cavity 23, and are equidistantly spaced. The vibration exciters 26 are attached to the glass housing 21, and are used for driving the glass housing 21 to vibrate, thus generating sound waves. The vibration exciters 26 may be products HIAX25C10-8/HS or HiHX14CO2-08 of HiWave Technologies PLC.

In the first embodiment, the vibration exciters 26 are attached to an inner surface 22*c* of the outer wall 21*c*, and the inner surface 22*c* of the outer wall 21*c* is exposed in the receiving cavity 23. In other embodiments, the vibration exciters 26 can be attached to an inner surface 22*a* of the front wall 21*a* or an inner surface 22*b* of the back wall 21*b*, and the inner surface 22*a* of the front wall 21*a* and an inner surface 22*b* of the back wall 21*b* are exposed in the receiving cavity 23.

In use, the display panel 10 displays images according to the received image signals, and the vibration exciters 26 drive the glass housing 21 to vibrate, and thus to generate the sound waves.

Figure 4:
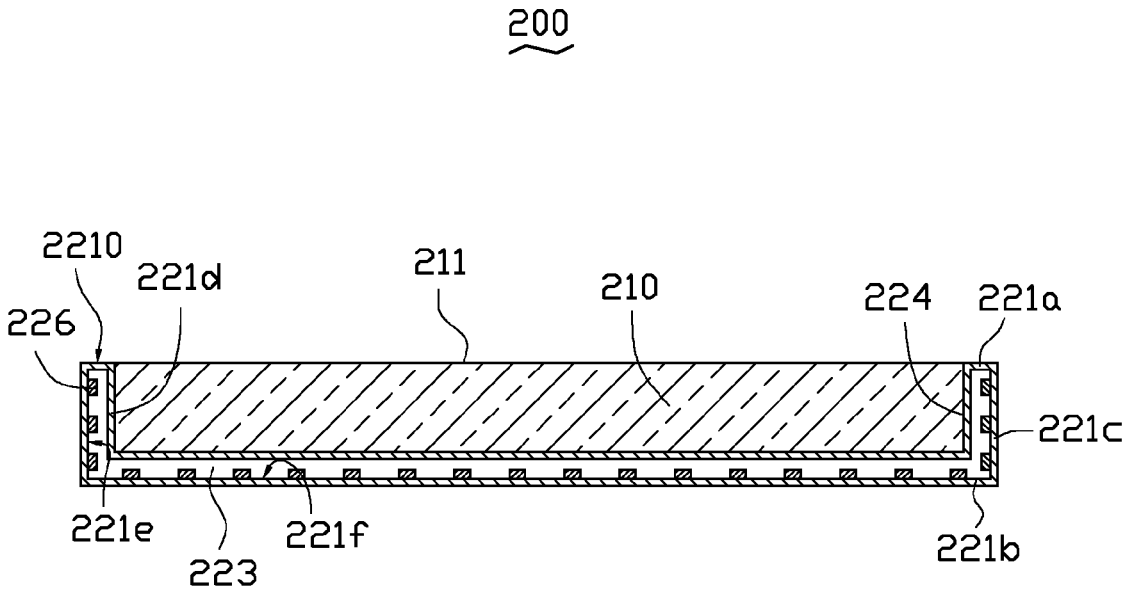
FIG. 4 is a cross-sectional view of a display, according to a second exemplary embodiment.
Figure 5:
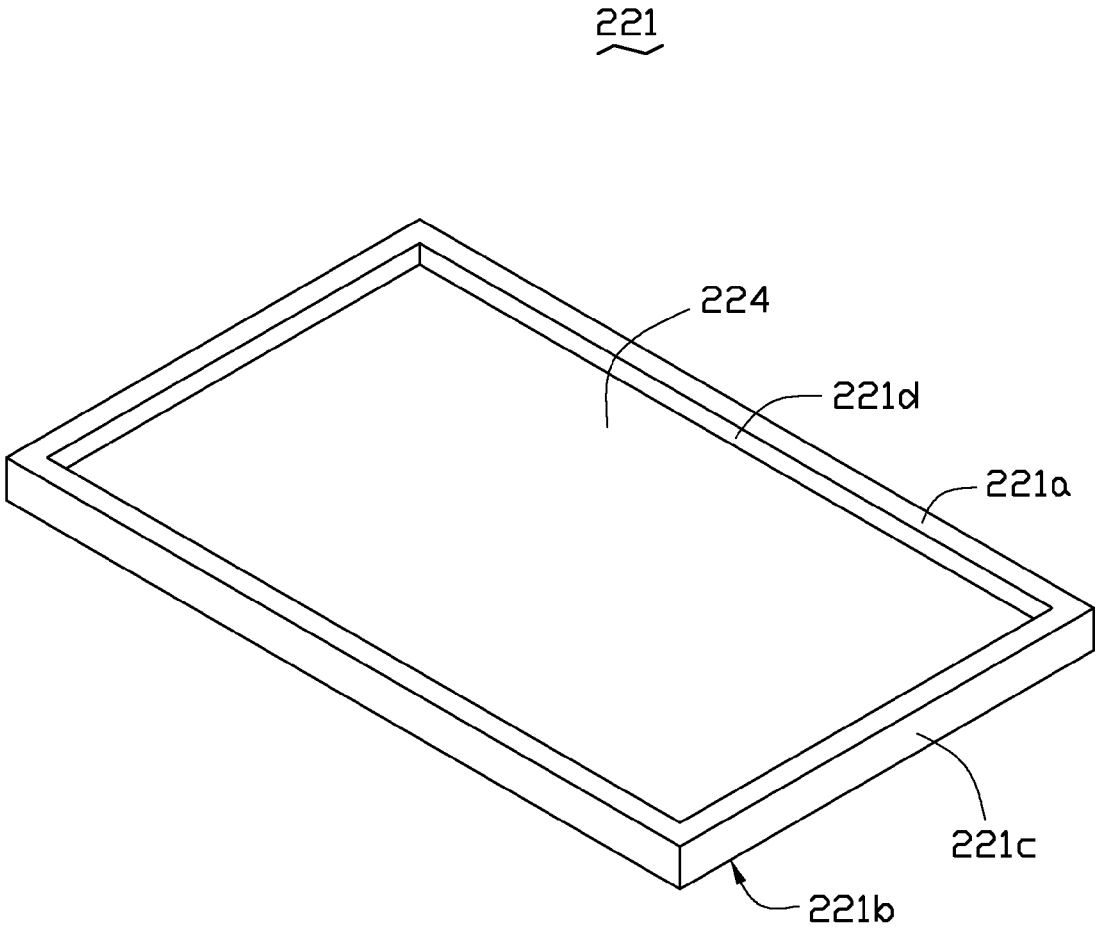
FIG. 5 is a schematic view of a glass housing of the display of FIG. 4.

FIGS. 4-5 show a display 200 according to a second exemplary embodiment. The differences between the display 200 and the display 100 are that, a particular surface 2210 of the glass housing 221 defines a receiving recess 224 rather than the through hole 24. The receiving recess 224 is used for receiving the display panel 210, and the display surface 211 is exposed from the receiving recess 224. The display surface 211 and the particular surface 2210 are at a same planar surface.

The glass housing 221 has a hermetical receiving recess 223, and includes a front wall 221*a*, a back wall 221*b*, an outer wall 221*c*, and an inner wall 221*d*. The front wall 221*a*, the outer wall 221*c*, and an inner wall 221*d* are substantially rectangular frame-shaped, and the back wall 221*b* is substantially a planar surface. The front wall 221*a* is adjacent to the display panel 210. The back wall 221*b* is opposite to the front wall 221*a*. The outer wall 221*c* is opposite to the inner wall 221*d*, and is connected to the front wall 221*a* and the back wall 221*b*. The inner wall 221*d* is connected to the front wall 221*a*. The inner wall 221*d* is in contact with the display panel 210, and is received in the receiving recess 223. The outer wall 221*c* is away from the display panel 210.

In the second embodiment, the vibration exciters 226 are attached to an inner surface 221*e* of the outer wall 221*c* and an inner surface 221*f* of the back wall 221*b*. The inner surface 221*e* of the outer wall 221*c* and the inner surface 221*f* of the back wall 221*b* are exposed in the receiving cavity 223. The inner surface 221*e* of the outer wall 221*c* is connected to the inner surface 221*f* of the back wall 221*b*. In other embodiments, the vibration exciters 226 are attached to the inner surface 221*e* of the outer wall 221*c* or the inner surface 221*f* of the back wall 221*b*.

Figure 6:
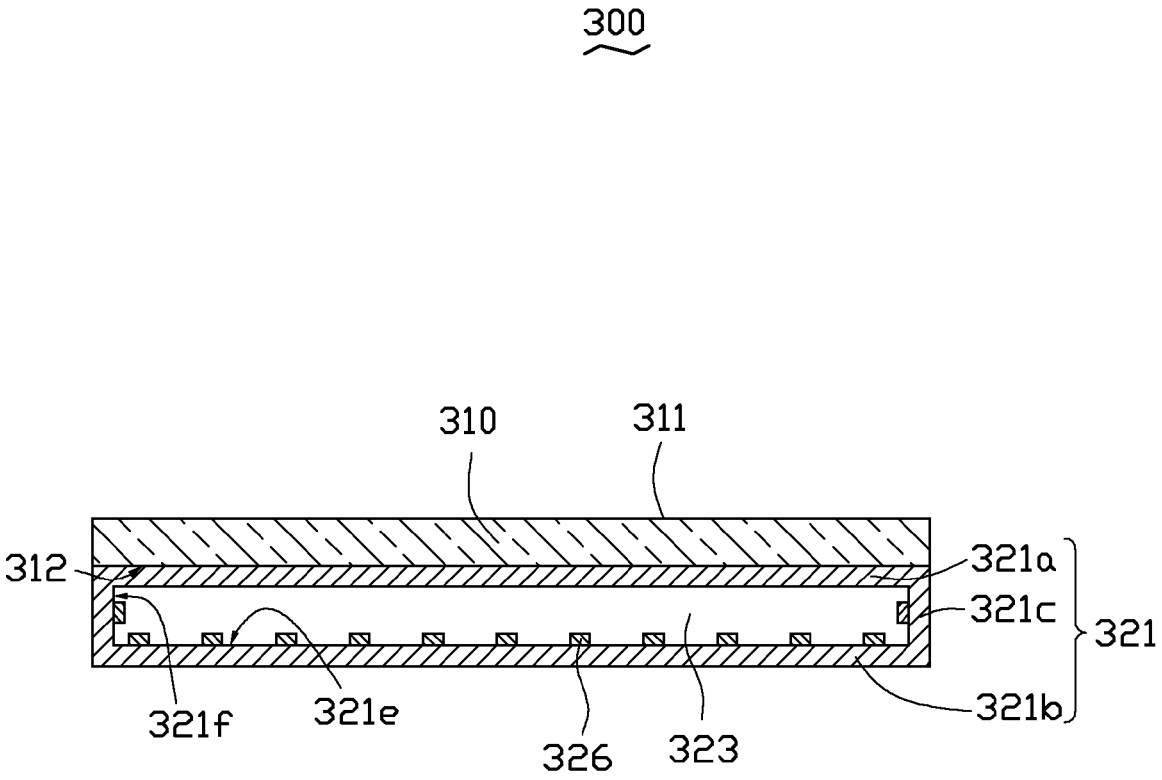
FIG. 6 is a cross-sectional view of a display, according to a third exemplary embodiment.

FIG. 6 shows a display 300 according to a third exemplary embodiment. The differences between the display 300 and the display 100 are that, the display panel 310 has a display surface 311 and a back surface 312 opposite to the display surface 311. The glass housing 321 is fixed on the back surface 312. The glass housing 321 defines a hermetical receiving cavity 323, and has a front wall 321*a*, a back wall 321*b*, and four sidewalls 321*c*. The front wall 321*a* is in contact with the display panel 310. The back wall 321*b* is opposite to the front wall 321*a*, and is away from the display panel 310. The four sidewalls 321*c* are connected to the front wall 321*a* and the back wall 321*b*. In the third embodiment, the vibration exciters 326 are attached to an inner surface 321*e* of the back wall 321*b* and four inner surfaces 321*f* of the four sidewalls 321*c*. The inner surface 321*e* of the back wall 321*b* and four inner surfaces 321*f* of the four sidewalls 321*c* are exposed in the receiving cavity 323, and the inner surface

321*e* of the back wall 321*b* is connected to the inner surfaces 321*f* of the four sidewalls 321*c*.

In other embodiments, the vibration exciters 326 can be only attached to at least one of the inner surface 321*e* of the back surface 321*b* or the four inner surfaces 321*f* of the four sidewalls 321*c*, or the vibration exciters 326 can be only attached to the four inner surfaces 321*f* of the four sidewalls 321*c*.

By employing the display with the speaker, an external speaker connected to the display can be omitted, which is very convenient.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A display comprising:

a display panel; and a speaker positioned on the display panel, the speaker comprising:

a hollow glass housing defining a hermetical receiving cavity; and a plurality of vibration exciters received in the receiving cavity, and being attached to the glass housing to drive the glass housing to vibrate, and thus generating sound waves;

wherein the glass housing is cuboid, the glass housing defines a receiving recess receiving the display panel therein, the display panel has a display surface, the display surface is exposed from the receiving recess, the glass housing has a front wall, a back wall, an inner wall, and an outer wall, the front wall is adjacent to the display surface, the back wall is opposite to the front wall, and is away from the display surface, the inner wall is exposed in the receiving recess and is in contact with the display panel, the outer wall is opposite to the inner wall, and is away from the display surface, the outer wall is connected to the front wall and the back wall, the vibration exciters are positioned on the inner surface of the outer wall or the inner surface of the back wall, the inner surface of the outer wall and the inner surface of the back wall are exposed in the receiving cavity, the inner surface of the outer wall is connected to the inner surface of the back wall.

2. A display comprising:

a display panel; and a speaker positioned on the display panel, the speaker comprising:

a hollow glass housing defining a hermetical receiving cavity; and a plurality of vibration exciters received in the receiving cavity, and being attached to the glass housing to drive the glass housing to vibrate, and thus generating sound waves;

wherein the display panel has a display surface and a back surface opposite to the display surface, the glass housing is attached to the back surface, the glass housing has a front wall, a back wall, and at least one sidewall, the front wall is in contact with the display panel, the back wall is opposite to the front wall, the at least one sidewall is connected to the front wall and the back wall, the vibration exciters are positioned on an inner surface of the back wall or an inner surface of the at least one sidewall, the inner surface of the back wall and the inner surface of the at least one sidewall are exposed in the receiving cavity, and the inner surface of the back wall is connected to the inner surface of the at least one sidewall.

* * * * *